US005558503A

United States Patent [19]

Weller et al.

[11] Patent Number: 5,558,503

[45] Date of Patent: Sep. 24, 1996

[54] HIGH-PRESSURE CLEANING DEVICE WITH BYPASS MECHANISM AND PULSATION DAMPEMING

[75] Inventors: Matthias Weller, Winnenden; Wilhelm Eisenmann, Althütte, both of Germany

[73] Assignee: Alfred Karcher GmbH & Co., Winnenden, Germany

[21] Appl. No.: 356,192

[22] PCT Filed: Apr. 20, 1993

[86] PCT No.: PCT/EP93/00958

§ 371 Date: Dec. 21, 1994

§ 102(e) Date: Dec. 21, 1994

[87] PCT Pub. No.: WO94/00690

PCT Pub. Date: Jan. 6, 1994

[30] Foreign Application Priority Data

Jun. 27, 1992 [DE] Germany ..... 42 21 192.1

[51] Int. Cl.[6] ..... F04B 49/00

[52] U.S. Cl. ..... 417/307; 417/189; 417/76

[58] Field of Search ..... 417/300, 307, 417/76, 186, 189, 540

[56] References Cited

U.S. PATENT DOCUMENTS

| | | | |
|---|---|---|---|
| 2,707,021 | 4/1955 | Harris | 417/76 |
| 2,721,520 | 10/1955 | Termont | 417/186 |
| 3,473,480 | 10/1969 | Kollmai | 417/540 |
| 3,754,841 | 8/1973 | Grabb et al. | 417/189 |
| 3,882,930 | 5/1975 | Schexnayder | 417/186 |
| 4,182,354 | 1/1980 | Bergstedt | 417/300 |

FOREIGN PATENT DOCUMENTS

| | | | |
|---|---|---|---|
| 708212 | 12/1930 | France | 417/307 |
| 2746037 | 4/1979 | Germany . | |
| 3124944 | 1/1983 | Germany . | |
| 3248622 | 7/1984 | Germany . | |

*Primary Examiner*—Timothy S. Thorpe
*Assistant Examiner*—Ted Kim
*Attorney, Agent, or Firm*—Barry R. Lipsitz; Ralph F. Hoppin

[57] ABSTRACT

In order to minimize the dimensions of the spring (22) and the pump motor in a high-pressure cleaning device comprising a high-pressure pump pumping cleaning liquid out of a suction line (1) into a pressure line (6) leading to a discharge device, a bypass line (18) leading from the pressure line to the suction line, a valve body (19) closing the outlet opening (8) between pressure line and bypass line, an actuating element (20) for the valve body which is movable against the valve body contrary to the action of a spring (22) into a position displacing the valve body into the open position, and an operating cylinder divided by a piston (10) sealingly displaceable therein and coupled to the actuating element into two chambers, (11,12) one of which is arranged between the outlet opening and the bypass line and the other of which communicates with the pressure line via a control line, the control line (13) exits the pressure line (6) in the region of a cross-sectional constriction (15) in this pressure line.

16 Claims, 1 Drawing Sheet

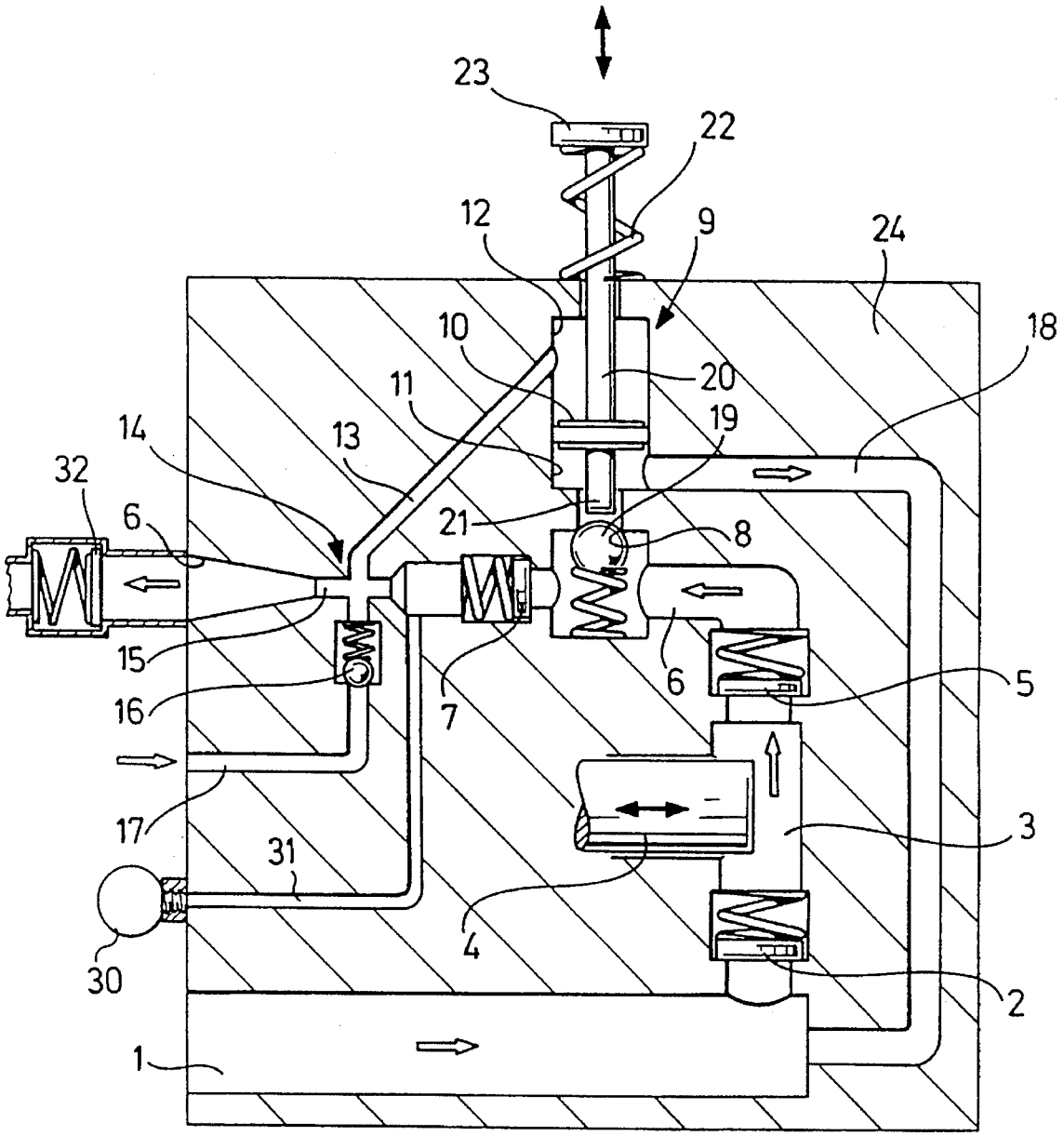
23
22
12
9
24
10
18
20
11
19
14
13
32
6
21
8
15
6
5
16
7
17
3
31
4
30
2
1

HIGH-PRESSURE CLEANING DEVICE WITH BYPASS MECHANISM AND PULSATION DAMPEMING

This application is a 371 of PCT/EP93/00958 filed Apr. 20, 1993.

BACKGROUND OF THE INVENTION

The invention relates to a high-pressure cleaning device comprising a high-pressure pump which pumps cleaning liquid out of a suction line into a pressure line leading to a discharge device, a bypass line leading from the pressure line to the suction line, a valve body closing the outlet opening between pressure line and bypass line, an actuating element for the valve body which is movable against the valve body contrary to the action of a spring into a position displacing the valve body into the open position, and an operating cylinder which is divided into two chambers by a piston sealingly displaceable in the cylinder and coupled to the actuating element, one of these chambers being arranged between the outlet opening and the bypass line and the other of these chambers communicating with the pressure line via a control line.

A high-pressure cleaning device of this type is known, for example, from DE-PS 31 24 944. With the control described therein it is possible to open the bypass line such that with a decrease in the cross section of the pressure line some of the liquid conveyed by the high-pressure pump is supplied to the suction side of the pump via the bypass line so that the amount of liquid which exits from the pressure line when this has a reduced outlet cross section is diminished. When the pressure line is closed, the bypass line is completely opened. In order, for this purpose, to be able to open the actuating element contrary to the action of the retaining spring, the pressure in the pressure line and in the control line branching of this line must rise to such an extent that it is above the pressure which occurs during normal operation. Only then can the force of the return spring be overcome and this force cannot be selected to be any less since, otherwise, the bypass line would be opened during normal operation in an undesired manner. A complete release of the bypass line therefore presupposes a pressure in the pressure line which is higher than during normal operation. Such an increase in pressure will put an exceptionally heavy strain on the electromotor of the high-pressure pump, i.e. it is necessary to dimension the electromotor such that it is also suitable for this overpressure operation. This means that the motors are required to be larger and more powerful than would be necessary as such for normal, continuous operation.

SUMMARY OF THE INVENTION

The object of the invention is to improve a high-pressure cleaning device of the generic type such that a comparable functioning can be achieved, whereby the component parts can be dimensioned such that they can already be utilized up to their capacity limits during normal operation.

This object is accomplished in accordance with the invention, for a high-pressure cleaning device of the type described at the outset, in that the control line exits from the pressure line in the region of a cross-sectional constriction thereof.

With this measure it is possible for the pressure in the chamber of the operating cylinder connected to the control line to be below the normal operating pressure in the pressure line during normal operation since a lower static pressure results in the region of the cross-sectional constriction due to the increased flow velocity caused by the constriction and the reduced value of the pressure is transferred via the control line to the chamber connected to it. When the liquid discharge is interrupted, for example when the pressure line is closed, there is no drop in pressure in the region of the cross-sectional constriction, and this increase in the pressure in the chamber connected to the control line leads to a displacement of the actuating element and to an opening of the outlet opening so that, as a result, the liquid conveyed by the pump can circulate via the bypass line.

The essential point in this respect is that the pressure which is necessary to open the outlet opening of the bypass line does not exceed the pressure which is generated by the pump during normal operation. As soon as the flow is interrupted, the pressure in the operating chamber connected to the control line rises to this operating pressure; a further increase in pressure is neither necessary nor is it generated by the pump. The result of this construction leads, on the one hand, to the fact that the retaining force and, with it, the dimensioning of the spring can be less than in known constructions since this spring is already intended to be compressed at the normal operating pressure and, on the other hand, to the fact that a motor can be used for the pump which is designed for lower maximum power since this pump will never be loaded over and above the normal operating conditions.

With this construction it is, therefore, possible to keep the dimensions of the pump smaller with the same power. In this respect, it is also an essential feature that the safety valve function of the actuating element and of the valve body can be improved due to the smaller dimensions of the spring since, should the pressure in the system rise above the normal operating pressure for undesired reasons, this increase in pressure will also be transferred to the chamber connected to the control line and lead to an opening of the outlet opening of the bypass line even at a relatively low overpressure. Since the retaining spring can be designed to be less rigid than in previous constructions, this safety valve effect already occurs at relatively low overpressures.

In the case of high-pressure cleaning devices, it is known per se to control the opening of the valve of the bypass line via a control line which exits from the pressure line in the region of a cross-sectional constriction therein. Such a high-pressure cleaning pump is described in DE-PS 32 48 622 but in contrast to the present construction this pump is based on a different principle for controlling the bypass line valve. The actuating element of the previous construction is controlled via a piston which is acted upon with high pressures on both sides. The chamber communicating with the bypass line is, namely, permanently connected to the pressure line so that operating pressure always prevails therein. The piston is essentially displaced by way of the pressures prevailing on both sides; an additional retaining spring, which keeps the piston in an open position, is not necessary for its operation. Moreover, it has been found in practice that the valve construction according to DE-PS 32 48 622 does not enable any gentle, gradual opening of the bypass valve but leads to an abrupt opening. This is due to the fact that during opening of the bypass valve the counterpressure acting on the piston suddenly breaks down so that the imbalance at the piston is suddenly increased as a result. In fact, undesired oscillations occur in the known valve constructions in the region of the valve body and these result from the fact that the conditions during opening and closing change abruptly.

A stable functioning of the closure valve of the bypass line without abrupt alterations is only made possible by the inventive combination of a safety valve construction with a spring, in which the actuating element is not therefore held in the open position by the operating pressure but by a special retaining spring, and a control line, which opens into the pressure line in an underpressure region, with a simultaneous reduction in the dimensions of both the spring and the motor in comparison with previous constructions.

In an advantageous development, the cross-sectional constriction in the pressure line can be formed by an injector drawing in chemicals by suction.

It is, in addition, favorable for a check valve to be arranged in the pressure line between the outlet opening of the bypass line and the outlet of the control line. When the pressure line is closed, the check valve maintains the pressure in the region located downstream of the check valve so that this pressure is also maintained in the chamber of the operating cylinder connected to the control line. This means that the valve body at the outlet opening of the bypass line is held in an open position until this pressure in the pressure line is reduced again by opening the same.

In a preferred embodiment, a check valve opening in outlet direction can be arranged in the pressure line downstream of the cross-sectional constriction. It has been found that this stabilizes the operation; pulsations possibly occurring are damped by such an additional check valve.

A further, improved development may be achieved by providing a pressure vessel which communicates with the pressure line via a connection line opening into the pressure line upstream of the cross-sectional constriction. This measure also contributes to damping any pulsations which may occur and to ensuring a smooth operation.

BRIEF DESCRIPTION OF THE DRAWING

The figure is a schematic of the main components of a high-pressure cleaning device.

DETAILED DESCRIPTION OF THE INVENTION

The following description of a preferred embodiment of the invention serves to explain the invention in greater detail in conjunction with the drawing. This shows schematically the most important component parts of a high-pressure cleaner.

Only that part of this high-pressure cleaning device which serves to convey the liquid as well as control the various operational states is illustrated schematically and in a simplified manner in the drawing. It goes without saying that the illustrated unit is to be connected to a supply line for a cleaning liquid, e.g. water, and that the cleaning liquid leaving this unit under high pressure can be discharged in a manner known per se via flexible high-pressure lines and spray guns or the like; these peripheral devices are not illustrated in the drawing.

A suction line 1 leads via a suction valve 2 into the pump chamber 3 of a high-pressure pump, of which only the piston 4 which enters the pump chamber 3 in a sealing and oscillating manner is illustrated in the drawing. An electromotor which is not shown in the drawing is used, for example, as a drive means.

The pump chamber 3 communicates via a pressure valve 5 with a pressure line 6, into which a check valve 7 opening in flow direction is inserted. The pressure line 6 leads in the manner described via a high-pressure hose or the like to a discharge device which is not represented in the drawing.

Upstream of the check valve 7 the pressure line 6 is connected via an outlet opening 8 to an operating cylinder 9 which is divided by a piston 10 sealingly displaceable therein into two chambers, namely a lower chamber 11 communicating with the outlet opening 8 and an upper chamber 12, into which a control line 13 opens. This connects the upper chamber 12 with a chemical injector 14 arranged downstream of the check valve 7 in the pressure line 6. This chemical injector 14 essentially represents a constriction 15 in the pressure line 6, a chemical suction line 17 closed via a check valve 16 opening into the pressure line 6 in the region of this constriction 15. The control line 13 also opens into the pressure line 6 in the region of this constriction 15.

A check valve 32 opening in outflow direction is arranged in the pressure line 6 downstream of the constriction 15.

Moreover, a connection line 31 opens into the pressure line 6 upstream of the constriction 15 and this connects the pressure line 6 to a pressure vessel 30 of a type known per se.

A bypass line 18 exits from the lower chamber 11 and leads to the suction line 1. The outlet opening 8 between the pressure line 6 and the lower chamber 11 is closed by means of a ball-shaped, spring-loaded valve body 19 which is pressed against the outlet opening 8 from the side of the pressure line.

The piston 10 is arranged on a piston rod 20 which dips with its free end 21 into the outlet opening 8 and ends directly adjacent the valve body 19. At the opposite end of the operating cylinder 9, the piston rod 20 exits sealingly from the operating cylinder 9 and is mounted for displacement in this region. A helical spring 22 surrounding the piston rod 20 is supported, on the one hand, on a pressure plate 23 connected to the piston rod 20 and, on the other hand, on the device part 24 accommodating the operating cylinder 9 such that the piston 10 and the piston rod 20 are moved away from the valve body 19, i.e. that they are displaced into a closed position, in which the valve body 19 is not displaced by the free end of the piston rod 20. Piston 10 and piston rod 20 may be displaced contrary to the action of the helical spring 22 such that the valve body 19 is displaced contrary to the action of the spring closure force until the outlet opening 8 is released.

During operation, the pump conveys liquid under high pressure through the pressure line 6. When the pressure line is open, the liquid is discharged completely via the pressure line. At the same time, a reduction in the static pressure dependent on the flow velocity is generated in the region of the injector 14 due to the constriction 15. This leads, on the one hand, to chemicals being drawn in by suction via the chemical suction line 17 and, on the other hand, to a pressure in the upper chamber 12 which is below the operating pressure generated by the pump. The drop in pressure in comparison with the operating pressure is dependent on the volume of flow in the region of the chemical injector 14. The pressure generated in this manner in the upper chamber counteracts the force of the helical spring 22; this is, however, dimensioned such that piston 10 and piston rod 20 remain in the closed position of the valve body 19, i.e. the helical spring 22 is not compressed. In this phase, the bypass line 18 is therefore completely separated from the pressure line 6.

If the discharge of liquid via the pressure line 6 is interrupted, for example by closure of an outlet valve, the volume of flow in the region of the chemical injection 14 is also interrupted so that, in this region, no more reduction in the static pressure takes place. The pressure in the upper chamber 12 of the operating cylinder 9 therefore increases via the control line 13 to the normal operating pressure of the pump. This increase in pressure is now sufficient to displace the piston 10 and the piston rod 20 contrary to the action of the helical spring 22 so that thereby the valve body 19 is moved away from the outlet opening 8 and releases it. This means that the liquid conveyed by the high-pressure pump can circulate to the suction line 1 again via the bypass line 18, the pressure in the lower chamber 11 and in the bypass line being considerably less than the operating pressure. This operating pressure is, however, maintained in full in the region downstream of the check valve 7 due to its action so that the opening displacement of the valve body 19 is also maintained for as long as this pressure is not reduced. Such a reduction in pressure will not take place until the pressure line is opened and this then leads to a drop in pressure in the upper chamber 12 so that the helical spring 22 moves the piston 10 and the piston rod 20 back again into the closed position, in which the valve body 19 closes the outlet opening 8. This means that the normal operating conditions described at the outset are reestablished.

During this operating procedure, a pressure above the normal operating pressure of the high-pressure pump will not occur at any time in the system; all the control procedures will also be carried out reliably without exceeding this operating pressure. Consequently, it is not necessary to design the helical spring 22 or the drive motor of the pump for higher pressures.

Both the check valve 32 and the pressure vessel 30 sustain a uniform, pulsation-free operation so that, on the one hand, sudden opening and closing movements of the valve are avoided due to the construction with the valve in the bypass line while, on the other hand, any pressure variations remaining are stabilized by the pressure vessel 30 and the check valve 32.

We claim:

1. A high-pressure cleaning device comprising:

a high-pressure pump for pumping cleaning liquid out of a suction line into a pressure line leading to a discharge device;

a bypass line for communicating liquid from the pressure line to the suction line;

a valve body closing an outlet opening between the pressure line and the bypass line;

an actuating element for the valve body, said element being movable against the valve body contrary to the action of a spring into a position displacing said valve body into an open position; and an operating cylinder divided into a first and a second chamber by a piston sealingly displaceable in said cylinder and coupled to the actuating element, said first chamber being arranged between the outlet opening and the bypass line and said second chamber communicating with the pressure line via a control line;

said valve body positioned between said first chamber and the pressure line to preclude communication therebetween when said outlet opening is closed;

wherein the control line exits from the pressure line in a region of a cross-sectional constriction thereof.

2. A high-pressure cleaning device as defined in claim 1, wherein said cross-sectional constriction is formed by an injector adapted to draw in chemicals by suction.

3. A high-pressure cleaning device as defined in claim 2, wherein a check valve is arranged in the pressure line between the outlet opening of the bypass line and an outlet of the control line.

4. A high-pressure cleaning device as defined in claim 3, wherein a check valve that opens in an outlet direction is arranged in the pressure line downstream of said cross-sectional constriction.

5. A high-pressure cleaning device as defined in claim 4, further comprising a pressure vessel, said pressure vessel communicating with the pressure line via a connection line opening into the pressure line upstream of said cross-sectional constriction.

6. A high-pressure cleaning device as defined in claim 3, further comprising a pressure vessel, said pressure vessel communicating with the pressure line via a connection line opening into the pressure line upstream of said cross-sectional constriction.

7. A high-pressure cleaning device as defined in claim 2, wherein a check valve that opens in an outlet direction is arranged in the pressure line downstream of said cross-sectional constriction.

8. A high-pressure cleaning device as defined in claim 7, further comprising a pressure vessel, said pressure vessel communicating with the pressure line via a connection line opening into the pressure line upstream of said cross-sectional constriction.

9. A high-pressure cleaning device as defined in claim 2, further comprising a pressure vessel, said pressure vessel communicating with the pressure line via a connection line opening into the pressure line upstream of said cross-sectional constriction.

10. A high-pressure cleaning device as defined in claim 1, wherein a check valve is arranged in the pressure line between the outlet opening of the bypass line and an outlet of the control line.

11. A high-pressure cleaning device as defined in claim 10, wherein a check valve that opens in an outlet direction is arranged in the pressure line downstream of said cross-sectional constriction.

12. A high-pressure cleaning device as defined in claim 11, further comprising a pressure vessel, said pressure vessel communicating with the pressure line via a connection line opening into the pressure line upstream of said cross-sectional constriction.

13. A high-pressure cleaning device as defined in claim 10, further comprising a pressure vessel, said pressure vessel communicating with the pressure line via a connection line opening into the pressure line upstream of said cross-sectional constriction.

14. A high-pressure cleaning device as defined in claim 1, wherein a check valve that opens in an outlet direction is arranged in the pressure line downstream of said cross-sectional constriction.

15. A high-pressure cleaning device as defined in claim 14, further comprising a pressure vessel, said pressure vessel communicating with the pressure line via a connection line opening into the pressure line upstream of said cross-sectional constriction.

16. A high-pressure cleaning device as defined in claim 1, further comprising a pressure vessel, said pressure vessel communicating with the pressure line via a connection line opening into the pressure line upstream of said cross-sectional constriction.

* * * * *